US008290784B2

(12) United States Patent
Honma

(10) Patent No.: US 8,290,784 B2
(45) Date of Patent: Oct. 16, 2012

(54) SIGNAL PROCESSING METHOD AND PROGRAM

(75) Inventor: Hiroyuki Honma, Chiba (JP)

(73) Assignee: Sony Corporation, Tokyo (JP)

( * ) Notice: Subject to any disclaimer, the term of this patent is extended or adjusted under 35 U.S.C. 154(b) by 288 days.

(21) Appl. No.: 12/524,992

(22) PCT Filed: Jun. 26, 2008

(86) PCT No.: PCT/JP2008/061614

§ 371 (c)(1),
(2), (4) Date: Jul. 29, 2009

(87) PCT Pub. No.: WO2009/016902

PCT Pub. Date: Feb. 5, 2009

(65) Prior Publication Data

US 2010/0131281 A1 May 27, 2010

(30) Foreign Application Priority Data

Jul. 30, 2007 (JP) ..... 2007-197960

(51) Int. Cl.
*G10L 19/00* (2006.01)

(52) U.S. Cl. ..... 704/501; 704/500; 704/503; 704/504

(58) Field of Classification Search ..... 704/503, 704/500, 501, 504
See application file for complete search history.

(56) References Cited

U.S. PATENT DOCUMENTS 5,717,821 A 2/1998 Tsutsui et al.
6,366,545 B2 4/2002 Koyata
7,328,162 B2 * 2/2008 Liljeryd et al. ..... 704/503
2004/0196770 A1 * 10/2004 Touyama et al. ..... 369/59.11
2004/0250287 A1 * 12/2004 Haneda et al. ..... 725/93
2007/0282603 A1 * 12/2007 Bessette ..... 704/219

FOREIGN PATENT DOCUMENTS

EP 0 920 127 A2 6/1999
EP 1 081 684 A2 3/2001
JP 2001-134294 A 5/2001
JP 3336617 8/2002
JP 2002-304198 A 10/2002
JP 2006-317549 A 11/2006
JP 3879249 11/2006

(Continued)

OTHER PUBLICATIONS

Extended European Search Report issued in European Patent Application No. 08790629.3, dated Jun. 22, 2012.

(Continued)

*Primary Examiner* — Qi Han
(74) *Attorney, Agent, or Firm* — Finnegan, Henderson, Farabow, Garrett & Dunner, L.L.P.

(57) ABSTRACT

The present invention provides a signal processing apparatus, a signal processing method and a program for outputting a high-quality coded string. A signal processing apparatus according to an embodiment of the present invention includes a normalization coefficient information increasing/decreasing circuit 12 for modifying normalization coefficient information of a signal component of a frame and normalization coefficient information of a primary additional signal component according to a normalization coefficient information primary increase/decrease amount, and an additional signal component normalization coefficient information increasing/decreasing circuit 14 for modifying normalization coefficient information of a secondary additional signal component, which is a copy of the primary additional signal component, according to a normalization coefficient information secondary increase/decrease amount.

6 Claims, 12 Drawing Sheets

FOREIGN PATENT DOCUMENTS

JP 3879250 11/2006

OTHER PUBLICATIONS

Office Action issued in Japanese Patent Application No. 2007-197960, dated Jun. 19, 2012.

Sreenivas et al., "Vector Quantization of Scale Factors in Advanced Audio Coder (AAC)", The Proceedings of the 1998 IEEE International Conference on Acoustics, Speech and Signal Processing; *IEEE*, vol. 6, pp. 3641-3644 (1998).

Yoshida, "The Rewritable MiniDisc System", Proceedings of the IEEE; *IEEE*, vol. 82, No. 10, pp. 1492-1500 (1994).

* cited by examiner

FIG.7

| frame | SFfi1 (frame) | SFfi2 (frame) |
|---|---|---|
| 112 | 2 | 8 |
| 113 | 1 | 22 |
| 114 | 1 | 19 |
| 115 | 1 | 17 |
| 116 | 1 | 16 |
| 117 | 1 | 15 |
| 118 | 1 | 14 |
| 119 | 1 | 13 |
| 120 | 1 | 13 |
| 121 | 1 | 12 |
| 122 | 1 | 12 |
| 123 | 1 | 12 |
| 124 | 1 | 11 |
| 125 | 1 | 11 |
| 126 | 1 | 11 |
| 127 | 1 | 10 |
| 128 | 1 | 10 |
| ⋮ | ⋮ | ⋮ |
| 159 | 1 | 7 |

FIG.10

| SF | SFval (SF) |
|---|---|
| 0 | 0.031250 |
| 1 | 0.039373 |
| 2 | 0.049606 |
| 3 | 0.062500 |
| ⋮ | ⋮ |
| 62 | 52016 |
| 63 | 65536 |

SFval (SF) = 2^(SF/3−5)

FIG.12

| frame | SFfi (frame) |
|---|---|
| 1 | 41 |
| 2 | 35 |
| 3 | 31 |
| 4 | 29 |
| 5 | 27 |
| 6 | 25 |
| 7 | 24 |
| 8 | 23 |
| ⋮ | ⋮ |
| 80 | 4 |
| 81 | 3 |
| ⋮ | ⋮ |
| 93 | 3 |
| 94 | 2 |
| ⋮ | ⋮ |
| 112 | 2 |
| 113 | 1 |
| ⋮ | ⋮ |
| 159 | 1 |

SIGNAL PROCESSING METHOD AND PROGRAM

TECHNICAL FIELD

The present invention relates to a signal processing apparatus, a signal processing method, and a program which are suitable for use in a case of increasing or decreasing the volume without decoding a code string.

BACKGROUND ART

High efficiency coding of audio signal allows for compressing the sound quality that corresponds to a CD (Compact Disk) into a data amount of approximately 1/10 to 1/20 that of the original CD, by using the mechanism of human hearing. Currently, products using such technologies are distributed in the marketplace, thereby allowing for recording on a smaller recording medium and delivering via a network, for example. Main hearing characteristics used in such high efficiency coding of audio signal is simultaneous and temporal masking.

Simultaneous masking is a hearing characteristic that, in a case where sounds at different frequencies exist at the same time, when there is a small-amplitude sound in the neighborhood of the frequency of a large-amplitude sound, the small-amplitude sound is masked and becomes hard to perceive.

On the other hand, temporal masking is a masking effect in the temporal direction, and is a hearing characteristic that, for example, a small-amplitude sound existing at a time before or after a large-amplitude sound is masked to be hard to perceive. There are two phenomena for the temporal masking: forward masking where temporally-before generated sounds mask temporally-after generated sounds; and backward masking where a temporally-after generated sounds mask temporally-before generated sounds. It is known that forward masking is effective for a period in the order of several tens of msec (milliseconds) while backward masking is effective for an extremely short period of approximately 1 msec.

In a typical high efficiency coding method for audio, after orthogonally transforming a time signal by MDCT (Modified Discrete Cosine Transform), normalization is performed on the obtained MDCT coefficients on a frequency axis for each set of a plurality of MDCT coefficients (hereinafter referred to as "quantization unit"), and then, quantization and coding are performed.

The range of a quantization unit is generally narrow in the lower region and wide on the higher region, which allows for changing the number of quantization steps adaptively for each quantization unit and controlling the generation of quantization noise acceptable to the hearing properties.

However, in the above-described method, the band in which frequency components are quantized is fixed. Thus, for example, when spectra concentrate in a specific narrow band, in order to quantize the spectral components thereof with sufficient accuracy, many bits should be allocated to many spectra included in the same quantization unit as one of these spectral components.

Generally, compared to quantization noise added to a signal where energy is evenly distributed over a wide frequency band, quantization noise in a tonal signal in which energy concentrates on a specific frequency thereof may be extremely loud to the ear, and result in a great acoustical disturbance. Further, without a sufficient accuracy for quantizing tonal components, when the spectrum component thereof are converted back into a signal on the time axis and combined to the preceding or following blocks, the distortion between the blocks will be large, resulting also in a great acoustical disturbance.

Thus, in order to code a tonal component, quantization should be performed with sufficient number of bits. It is needed to perform quantization by allotting many bits to many spectra in a quantization unit which include a tonal component when quantization accuracy is determined for each predetermined band as described above, thereby the coding efficiency decreases.

For an approach to solving such a problem, in Japan Patent No. 3336617 there is provided efficient coding even for a tonal signal by separating a frequency component into a plurality of signal components and coding them separately.

Meanwhile, in such high efficiency coding of audio signal, significant amounts of computation and memory are needed for coding/decoding. Therefore, in a case where once a simple signal processing is performed on a coded code string, a desired signal processing can be performed with a small amount of computation and a small memory, by directly changing the parameter of the code string, instead of by decoding and subsequently performing a desired signal processing and then re-coding.

Japan Patent No. 3879249 discloses an invention for enabling filtering of a signal by directly changing normalization coefficient information in a code string. Also, Japan Patent No. 3879250 discloses an invention for enabling level adjustment of a signal by directly changing normalization coefficient information in a code string.

[Patent Document 1] Japan Patent No. 3336617
[Patent Document 2] Japan Patent No. 3879249
[Patent Document 3] Japan Patent No. 3879250

DISCLOSURE OF THE INVENTION

Problems to be Solved by the Invention

However, when the inventions of the patents described above are directly applied, problems may arise according to the property of signal, depending on the form of fade function. Hereunder, the problems will be explained with reference to the drawings.

FIG. 10 is a diagram showing an example of the relation between 6-bit normalization coefficient information SF and the corresponding normalization coefficient_SFval(SF). Normalization coefficient information in the table can be converted by the following equation and can designate decibels of about −30 to 96 in 2 decibel steps, for example.

$$Sfval(SF)=2\hat{}(SF/3-5).$$

Further, FIG. 11 is a diagram showing the relation between the fade function_Fa(t) and the corresponding subtraction amount SFfi(frame) of normalization coefficient information at the time of directly changing normalization coefficient information in a code string and realizing fade-in. As shown in FIG. 11, the subtraction amount SFfi(frame) of normalization coefficient for each time frame is a value corresponding to the output of the fade function with the corresponding time as the input.

Further, FIG. 12 is a diagram showing, for example, the subtraction amount SFfi(frame) of normalization coefficient information corresponding to the fade function Fa(t) of the following equation.

$$Fa(t)=\sin\hat{}2(PI/2.0*t/N),$$

where the time N from a fade-in start to an end equals 159 frames. As shown in FIG. 12, SFfi is 1 for the 113th frame to 159th frame, and SFfi is 2 for the 94th frame to 112th frame.

Thus, in the latter half of the fade function, SFfi stays at a constant value for a long time, and the step size of the normalization coefficient is a 2-decibel step, so that when a stationary signal such as a sine wave with a constant amplitude is input, the moment when SFfi changes is perceived by a user.

The present invention has been proposed in view of such conventional circumstances, and has its object to provide a signal processing apparatus, a signal processing method, and a program outputting a high-quality coded string.

Means for Solving the Problems

To solve the above-described problem, a signal processing apparatus according to an embodiment of the present invention is a signal processing apparatus operable to adjust a level of a signal in a code string obtained by converting a time signal to a frequency component, separating the frequency component into a plurality of signal components, normalizing independently each of the plurality of signal components, and quantizing, coding and multiplexing the normalized signal components, the signal processing apparatus including demultiplexing means for demultiplexing the code string, increasing/decreasing means for adding or subtracting a first integer value to/from a normalization coefficient of each of the plurality of the demultiplexed signal components, additional signal component generating means for copying the signal component of a subset of the plurality of the demultiplexed signal components, adding or subtracting a second integer value to/from the normalization coefficient of each of the signal component of the subset, and generating an additional signal component, and multiplexing means for multiplexing the plurality of signal components and the additional signal component.

Further, a signal processing method according to an embodiment of the present invention is a signal processing method of adjusting a level of a signal in a code string obtained by converting a time signal to a frequency component, separating the frequency component into a plurality of signal components, normalizing independently each of the plurality of signal components, and quantizing, coding and multiplexing the normalized signal components, the signal processing method including a demultiplexing step of demultiplexing the code string, an increasing/decreasing step of adding or subtracting a first integer value to/from a normalization coefficient of each of the plurality of the demultiplexed signal components, an additional signal component generating step of copying the signal component of a subset of the plurality of the demultiplexed signal components, adding or subtracting a second integer value to/from the normalization coefficient of each of the signal component of the subset, and generating an additional signal component, and a multiplexing step of multiplexing the plurality of signal components and the additional signal component.

Further, a program according to an embodiment of the present invention is a program for causing a computer to execute signal processing of adjusting a level of a signal in a code string obtained by converting a time signal to a frequency component, separating the frequency component into a plurality of signal components, normalizing independently each of the plurality of signal components, and quantizing, coding and multiplexing the normalized signal components, the program including a demultiplexing step of demultiplexing the code string, an increasing/decreasing step of adding or subtracting a first integer value to/from a normalization coefficient of each of the plurality of the demultiplexed signal components, an additional signal component generating step of copying the signal component of a subset of the plurality of the demultiplexed signal components, adding or subtracting a second integer value to/from the normalization coefficient of each of the signal component of the subset, and generating an additional signal component, and a multiplexing step of multiplexing the plurality of signal components and the additional signal component.

EFFECT OF THE INVENTION

According to the present invention, a high-quality code string can be obtained by copying signal components of a subset of a plurality of signal components, adding or subtracting a second integer to/from normalization coefficients of each of the signal components of the subset, and generating an additional signal component.

BRIEF DESCRIPTION OF THE DRAWINGS

FIG. 7 is a diagram showing illustrative examples of a normalization coefficient information primary increase/decrease amount and a normalization coefficient information secondary increase/decrease amount.

FIG. 10 is a diagram showing an example of the relation between 6-bit normalization coefficient information and the corresponding normalization coefficient.

FIG. 11 is a diagram showing the relation between a fade function and the corresponding subtraction amount of normalization coefficient information at the time of realizing fade-in.

FIG. 12 is a diagram showing an example of normalization coefficient information subtraction amount corresponding to a fade function.

EXPLANATION OF NUMERALS

Figure 1:
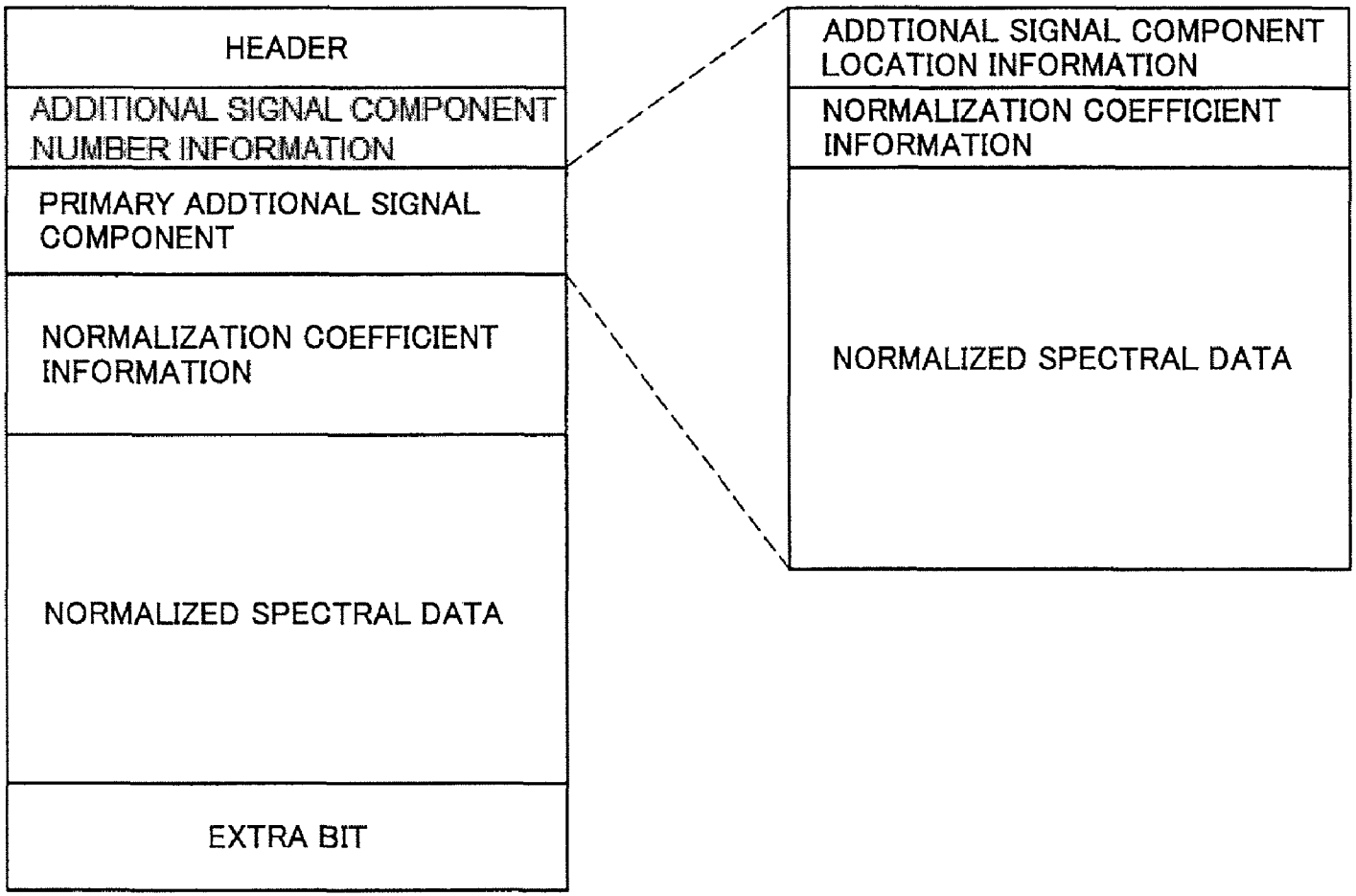
FIG. 1 is a diagram showing an example of coding frames which are included in a code string to be input to a signal processing apparatus.

10 signal processing apparatus
11 demultiplexer circuit
12 normalization coefficient information increasing/decreasing circuit
13 signal component addition determining circuit
14 additional signal component normalization coefficient information increasing/decreasing circuit
15 multiplexer circuit

BEST MODE FOR CARRYING OUT THE INVENTION

Hereunder, illustrative embodiments of the present invention will be explained with reference to the drawings. The signal processing apparatus presented as a specific example of the present invention is arranged to increase or decrease the volume without decoding code strings.

FIG. 1 is a diagram showing an example of coding frames which are included in a code string to be input to the signal processing apparatus. Each coding frame includes a header, additional signal component number information, a primary additional signal component, normalization coefficient information, normalization signal data, and extra bits.

As described in Japan Patent No. 3336617, for example, such a code string can be obtained by converting an input PCM (Pulse-Code Modulation) signal to a frequency component, separating the frequency component into a plurality of signal components, normalizing independently each of the plurality of signal components, and then, quantizing, coding, and multiplexing them.

A frequency component can be obtained by to-frequency-component converting a subband signal obtained by applying a subband dividing filter to an input PCM signal. Here, a frequency component may be obtained by to-frequency-component converting a time signal of a subband signal on which gain control has been performed. Additionally, it may be obtained by to-frequency-component converting a time signal of an input PCM signal on which gain control have been performed. Further, MDCT (Modified Discrete Cosine Transform) can be used for to-frequency-component converting.

Additional signal component number information is a value indicating the number of additional signal components, and in the example shown in FIG. 1, it is 1 since one primary additional signal component is included for the additional signal components. The primary additional signal component further includes additional signal component location information which indicates the location of the primary additional signal component on the frequency axis, normalization coefficient information which indicates the normalization coefficient of the primary additional signal component, and normalization spectral data of the primary additional signal component. Normalized spectral data is normalized with normalization coefficient information of spectral data. Extra bits are obtained by subtracting the number of bits used for all the code elements, which include the code elements described above, from the total number of bits used in a coding frame.

Thus, the primary additional signal component and the normalization spectral data are normalized respectively with their particular normalization coefficients, and are multiplexed in the code string along with their particular normalization coefficient information.

Figure 2:
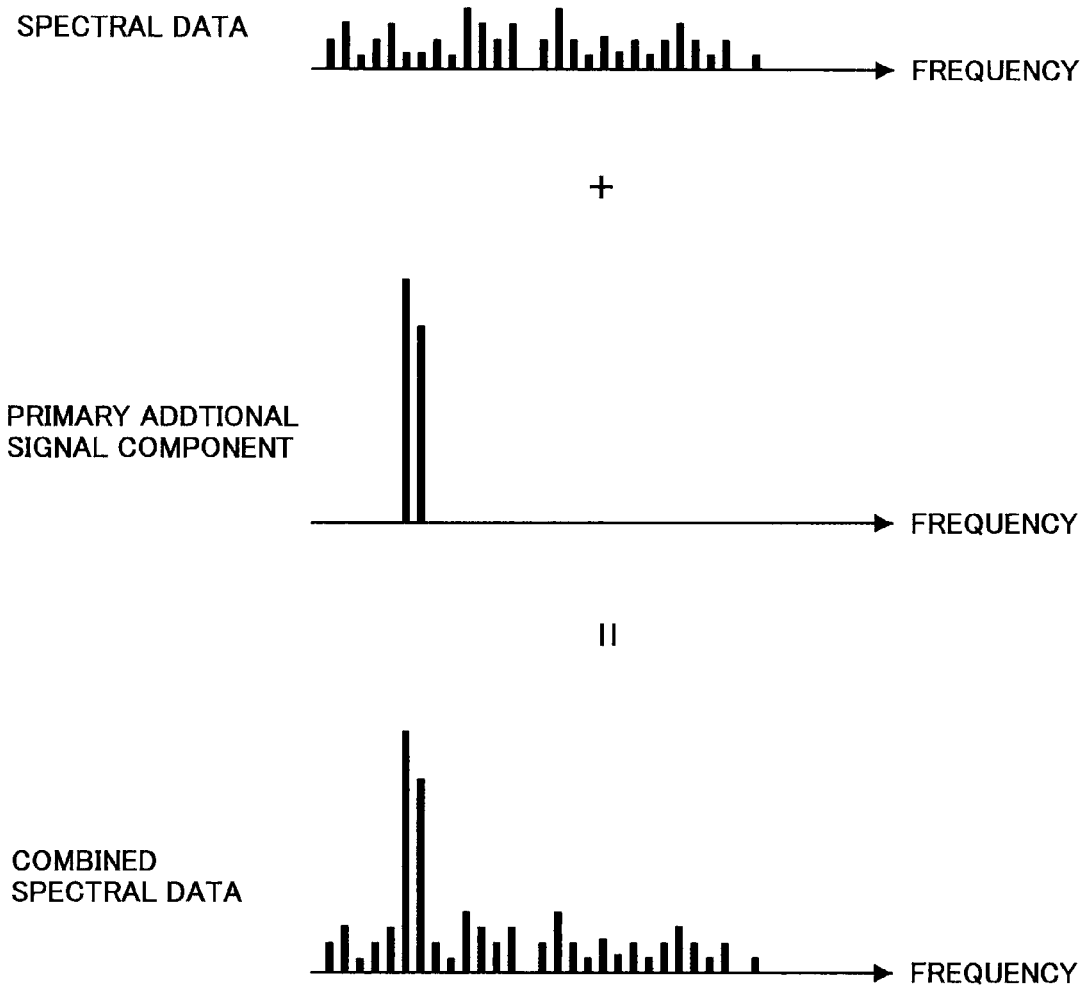
FIG. 2 is a diagram schematically showing the relation between a primary additional signal component and normalized spectral data.

FIG. 2 is a diagram schematically showing the relation between the primary additional signal component and the normalized spectral data. As shown in FIG. 2, when a coding frame as shown in FIG. 1 is decoded, addition of the normalized spectral data and the primary additional signal component results in combined spectral data, and frequency-time conversion of this results in an output time signal.

Figure 3:
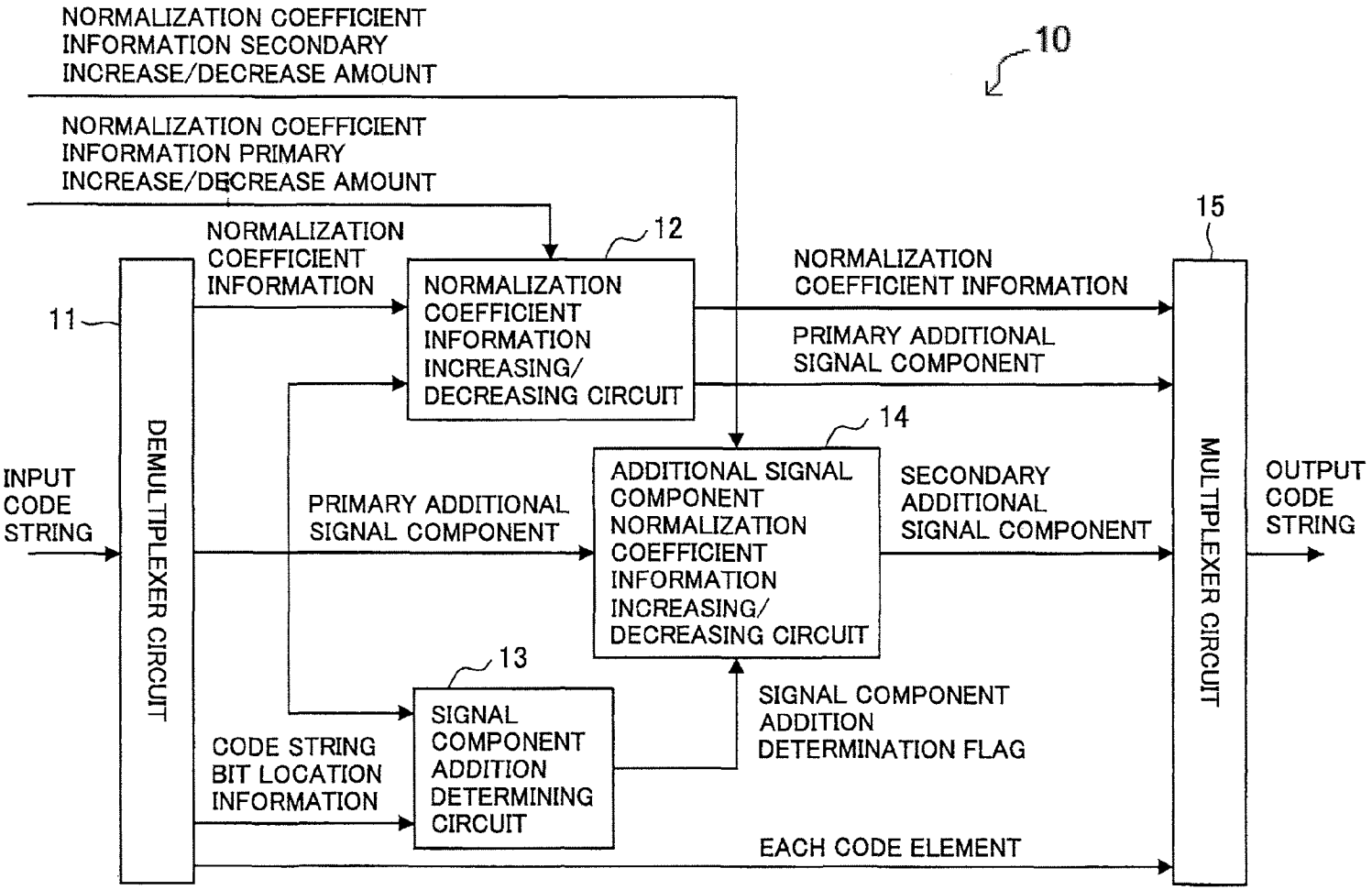
FIG. 3 is a block diagram showing a configuration of a signal processing apparatus of a first embodiment.

FIG. 3 is a block diagram showing a configuration of a signal processing apparatus of a first embodiment. The signal processing apparatus 10 includes a demultiplexer circuit 11 (demultiplexing means), a normalization coefficient information increasing/decreasing circuit 12 (increasing/decreasing means), a signal component addition determining circuit 13 (determining means), an additional signal component normalization coefficient information increasing/decreasing circuit 14 (additional signal component generating means), and a multiplexer circuit 15 (multiplexing means).

The demultiplexer circuit 11 demultiplexes an input code string, supplies normalization coefficient information to the normalization coefficient information increasing/decreasing circuit 12, supplies a primary additional signal component to the normalization coefficient information increasing/decreasing circuit 12, the signal component addition determining circuit 13 and the additional signal component normalization coefficient information increasing/decreasing circuit 14, supplies code string bit location information to the signal component addition determining circuit 13, and supplies each code element, such as normalized spectral data, to the multiplexer circuit 15.

The normalization coefficient information increasing/decreasing circuit 12 increases or decreases normalization coefficient information which includes the normalization coefficient information of the primary additional signal component, based on the below-described normalization coefficient information primary increase/decrease amount. If the calculation of the normalization coefficient information results in normalization coefficient information above the possible upper limit or below the possible lower limit, the normalization coefficient information is replaced by the upper or lower limit, respectively. The normalization coefficient information increased or decreased by the normalization coefficient information increasing/decreasing circuit 12 is supplied to the multiplexer circuit 15. Here, for increasing/decreasing of normalization coefficient information, a method similar to that of Japan Patent No. 3879250 can be used.

The signal component addition determining circuit 13 calculates the extra bit amount based on code string bit location information, and compares the extra bit amount and the code amount of the primary additional signal component. If the extra bit amount is over the code amount of the primary additional signal component, it determines that addition of the below-described secondary additional signal component is possible. Otherwise, if the extra bit amount is smaller than the code amount of the primary additional signal component, it determines that addition of the below-described secondary additional signal component is impossible. Then, the determination result is output to the additional signal component normalization coefficient information increasing/decreasing circuit 14 as a signal component addition determination flag.

If the signal component addition determination flag transmitted from the signal component addition determining circuit 13 is TRUE, the additional signal component normalization coefficient information increasing/decreasing circuit 14 copies the input primary additional signal component, and generates a secondary additional signal component. Then, based on the below-described normalization coefficient information secondary increase/decrease amount, the normalization coefficient information of the secondary additional signal component is increased or decreased. At this time, if the normalization coefficient information is above the possible upper limit or below the possible lower limit, it is replaced by the upper or lower limit, respectively. The secondary additional signal component generated by the additional signal component normalization coefficient information increasing/decreasing circuit 14 is transmitted to the multiplexer circuit 15.

The normalization coefficient information and the primary additional signal components which are output from the normalization coefficient information increasing/decreasing circuit 12, the secondary additional signal components which are output from the additional signal component normalization coefficient information increasing/decreasing circuit 14, and each code element which is output from the demultiplexer circuit 11 are input to the multiplexer circuit 15, and the multiplexer circuit 15 multiplexes each of the elements and outputs an output code string.

Also, the signal processing apparatus may be configured to further include a level control section (level control means) for calculating the normalization coefficient information primary increase/decrease amount and the normalization coefficient information secondary increase/decrease amount.

Figure 4:
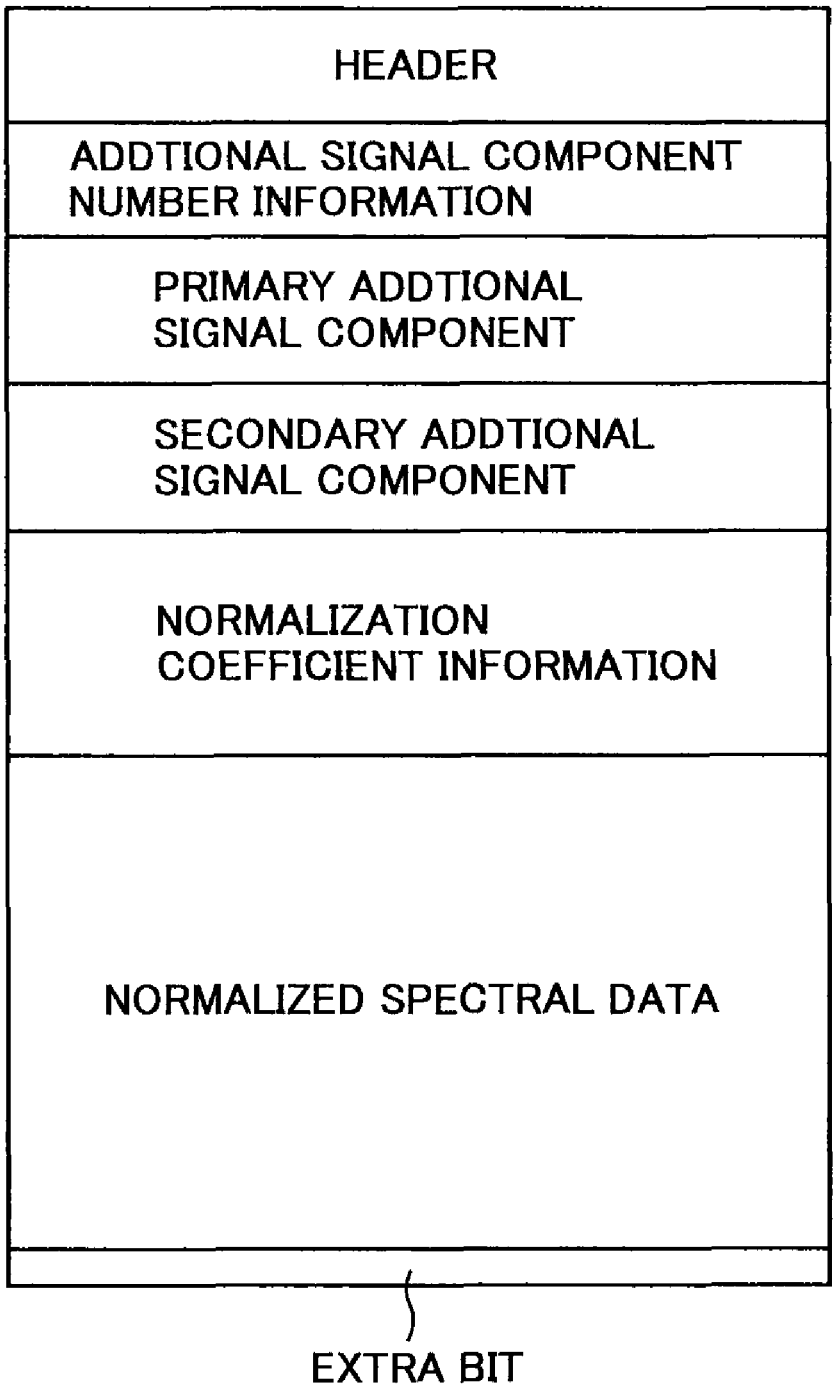
FIG. 4 is a diagram showing an example of an output code string which is output from a signal processing apparatus of the present embodiment.

FIG. 4 is a diagram showing an example of an output code string which is output from the signal processing apparatus of the present embodiment. Since a secondary additional signal component is newly added to the code string multiplexed by the multiplexer circuit 15, additional signal component number information is 2. Further, the extra bit amount is reduced by the amount of a primary additional component copied as the secondary additional component.

Thus, by copying a primary additional signal component, adding a new secondary additional signal component that uses the same normalization coefficient table, and increasing or decreasing respective normalization coefficient information of the primary additional signal component and the secondary additional signal component, adjustment can be allowed at a better granularity than the resolution of the normalization coefficient table.

Figure 5:
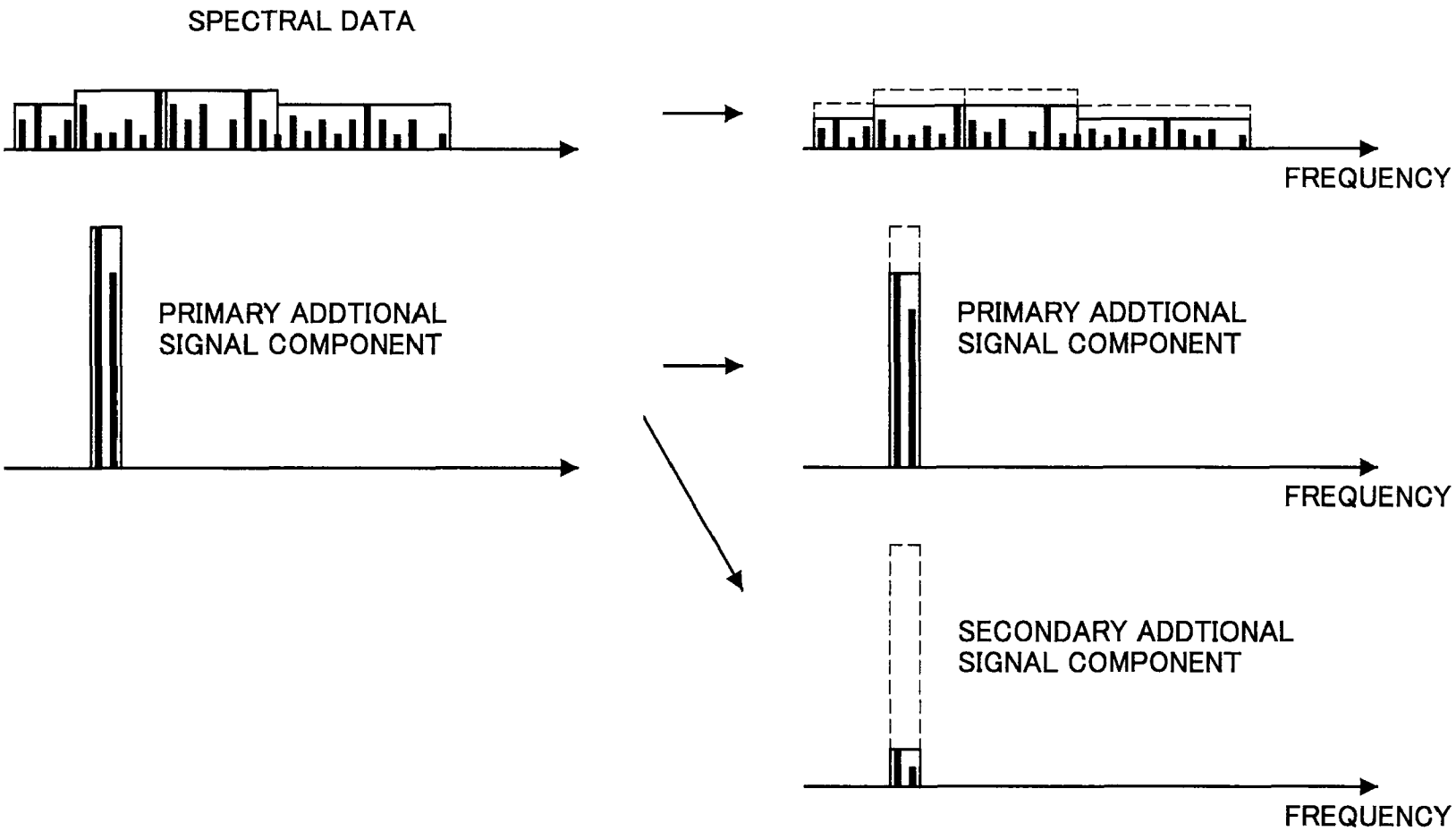
FIG. 5 is a diagram schematically showing increase/decrease of normalization coefficient information on a secondary additional signal component.

FIG. 5 is a diagram schematically showing a case of increasing or decreasing normalization coefficient information on a secondary additional signal component, along with increasing or decreasing normalization coefficient information on normalized spectral data and a primary additional signal component. In the views on the right in FIG. 5, the dotted lines indicate the normalization coefficient before modified, and on the other hand, the continuous lines indicate the normalization coefficient modified by the normalization coefficient information primary increase/decrease amount and the normalization coefficient information secondary increase/decrease amount.

For example, when the code string shown in FIG. 1 is input to the demultiplexer circuit 11, normalization coefficient information of a signal component of a frame and normalization coefficient information of a primary additional signal component are modified by the normalization coefficient information increasing/decreasing circuit 12, according to the normalization coefficient information primary increase/decrease amount. Further, normalization coefficient information of the secondary additional signal component is modified by the additional signal component normalization coefficient information increasing/decreasing circuit 14, according to the normalization coefficient information secondary increase/decrease amount. In other words, additional signal component location information, normalized spectrum and the like of the secondary coefficient signal component, which is a copy of the primary additional signal component, have only their normalization coefficient information modified with the normalization coefficient information secondary increase/decrease amount, using the value of the primary additional signal component.

Thus, a high-quality output time signal is obtained by frequency-time converting the combined spectral data, which is obtained by adding the normalized spectral data, the primary additional signal component and the secondary additional signal component whose pieces of normalization coefficient information are modified.

Next, the relation between the normalization coefficient information primary increase/decrease amount and the normalization coefficient information secondary increase/decrease amount will be explained. These increase/decrease amounts may be calculated by an external circuit corresponding to intervals of such as fade-in or fade-out, or may be read out respectively for each processing frame from pre-calculated values kept in a table or the like.

Figure 6:
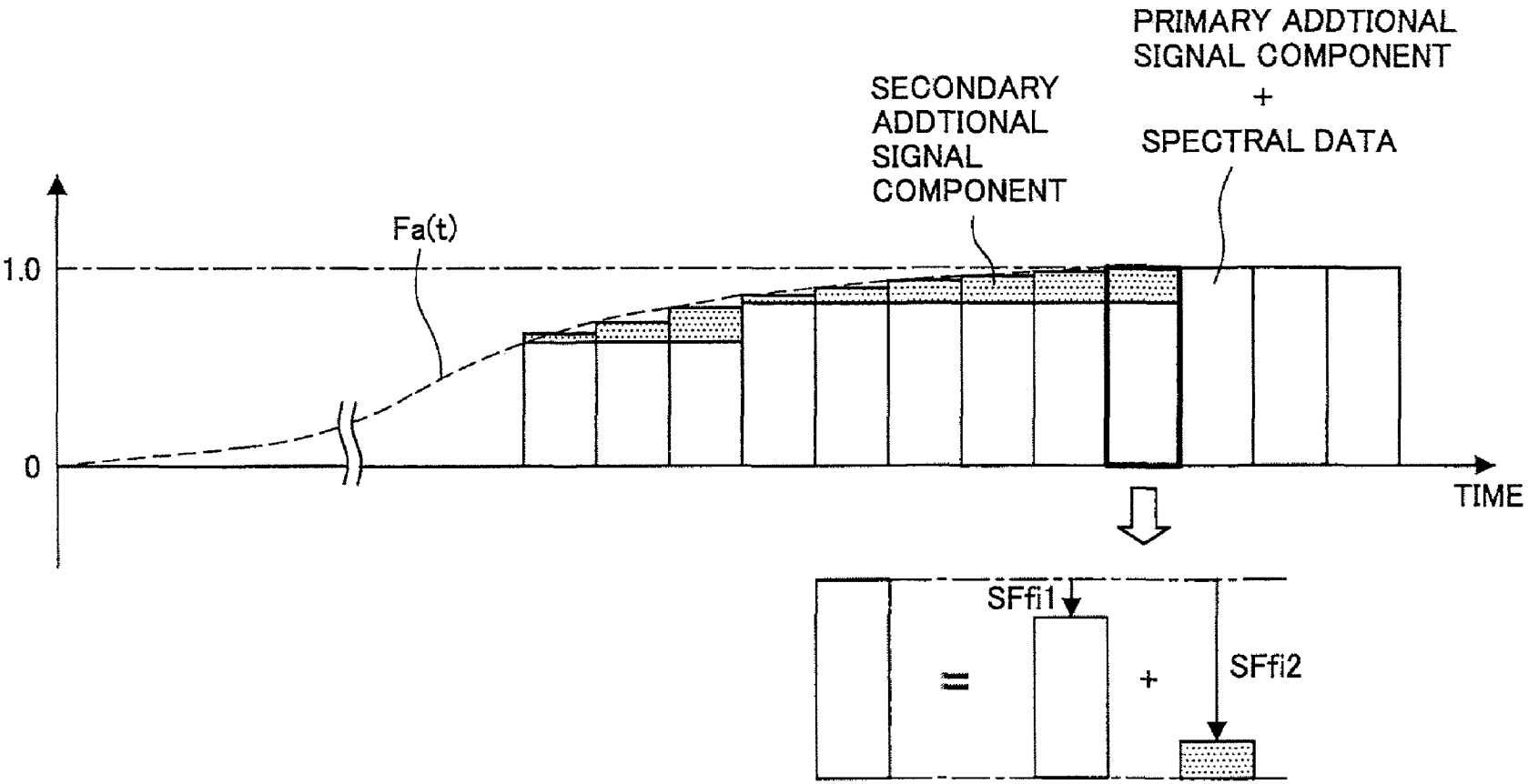
FIG. 6 is a diagram schematically showing the relation on the time axis between spectral data, a primary additional signal component and a secondary additional signal component.

FIG. 6 is a diagram schematically showing the relation on the time axis between spectral data, a primary additional signal component and a secondary additional signal component in a case where a code string output from the signal processing apparatus is decoded by a decoding apparatus. The shaded portion shown in the figure corresponds to the secondary additional signal component. The secondary additional signal component interpolates the portion in the shape like stairs, which results from the changes in the normalization coefficient information of the primary additional component and the spectral data.

Now, the relation between the normalization coefficient information primary increase/decrease amount and the normalization coefficient information secondary increase/decrease amount will be explained in detail. The normalization coefficient information primary increase/decrease amount is derived from the fade function Fa(t) described above by the following equation.

$$SFfi1(\text{frame})=-10*\log 10(Fa(\text{frame})).$$

Further, the normalization coefficient information secondary increase/decrease amount for interpolating the difference between Fa(frame) and SFfi1(frame), for example, is derived by the following equation.

$$SFfi2(\text{frame})=-10*\log 10(Fa(\text{frame})-10\hat{}(-SFfi1(\text{frame})/10)).$$

FIG. 7 is a diagram showing an example of SFfi 1(frame) and SFfi2(frame).

Thus, by generating an additional signal component whose normalization coefficient information is increased or decreased using the normalization coefficient information secondary increase/decrease amount so as to interpolate the difference between the fade function and the signal level adjusted by the normalization coefficient information primary increase/decrease amount, the minimum adjustment range of volume controlling due to the limit of the resolution of the normalization coefficient table can be adjusted at a better granularity than the resolution of the normalization coefficient table; thereby, a smooth output time signal of the fade function can be achieved.

Figure 8:
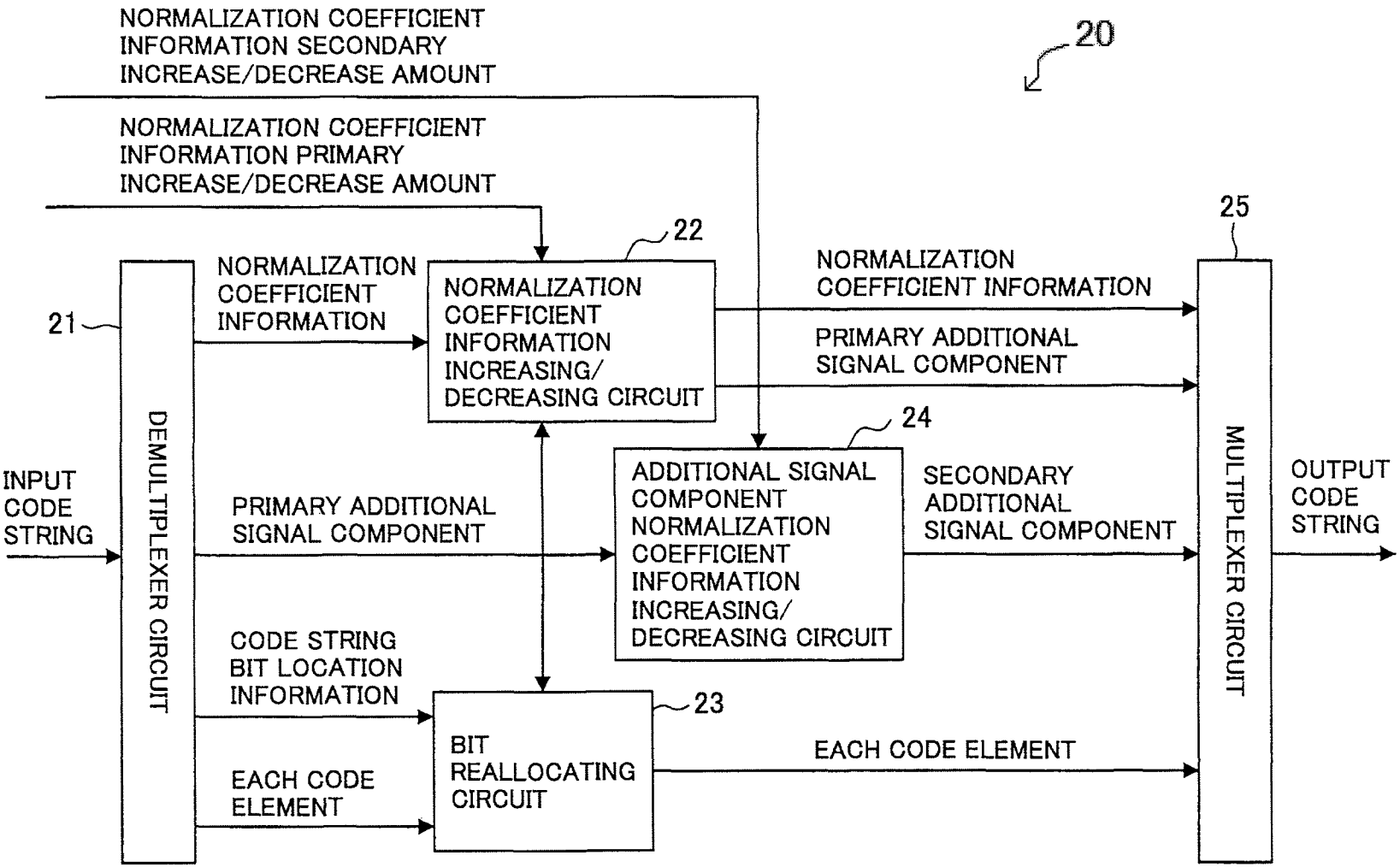
FIG. 8 is a block diagram showing a configuration of a signal processing apparatus of a second embodiment.

FIG. 8 is a block diagram showing a configuration of a signal processing apparatus according to a second embodiment. The signal processing apparatus 20 includes a demultiplexer circuit 21 (demultiplexing means), a normalization coefficient information increasing/decreasing circuit 22 (increasing/decreasing means), a bit reallocating circuit 23 (bit reallocating means), an additional signal component normalization coefficient information increasing/ decreasing circuit 24 (additional signal component generating means), and a multiplexer circuit 25 (multiplexing means). The signal processing apparatus 20 includes the bit reallocating circuit 23 for reserving extra bits, instead of the signal component addition determining circuit 13 in the signal processing apparatus 10 of the first embodiment.

The demultiplexer circuit 21 demultiplexes an input code string, supplies normalization coefficient information to the normalization coefficient information increasing/decreasing circuit 22, supplies a primary additional signal component to the normalization coefficient information increasing/decreasing circuit 22, the bit reallocating circuit 23 and the additional signal component normalization coefficient information increasing/decreasing circuit 24, and supplies each code element, such as code string bit location information and normalized spectral data, to the bit reallocating circuit 23.

The normalization coefficient information increasing/decreasing circuit 22 increases or decreases normalization coefficient information which includes the normalization coefficient information of the primary additional signal component, based on the normalization coefficient information primary increase/decrease amount. If the calculation of the normalization coefficient information results in normalization coefficient information above the possible upper limit or below the possible lower limit, the normalization coefficient information is replaced by the upper or lower limit, respectively. The normalization coefficient information increased or decreased by the normalization coefficient information increasing/decreasing circuit 22 is supplied to the multiplexer circuit 25.

The code string bit location information, the primary additional signal component and each code element which are provided by the demultiplexer circuit 21 are input to the bit reallocating circuit 23, the bit reallocating circuit 23 determines whether there is a sufficient bit amount for producing a secondary additional signal component from the primary additional signal component. And, if the bit amount is insufficient, the bits of spectral data or the like are reduced by reallocating the bits so as to provide a bit amount which allows for adding the secondary additional signal component.

For the bit reallocation, a bit allocation algorithm for a common high-efficiency coding method for audio can be used. Also, a simple method of bit reduction may also be applied for letting the normalized spectral data of the frequency band be 0, with the normalization coefficient of the higher region of the frequency band small, by taking advantage of the fact that bits are already allocated.

The additional signal component normalization coefficient information increasing/decreasing circuit 24 copies the input primary additional signal component, and generates a secondary additional signal component. Then, based on the normalization coefficient information secondary increase/decrease amount, the normalization coefficient information of the secondary additional signal component is increased or decreased. At this time, if the normalization coefficient information is above the possible upper limit or below the possible lower limit, it is replaced by the upper or lower limit, respectively. The secondary additional signal component generated by the additional signal component normalization coefficient information increasing/decreasing circuit 24 is transmitted to the multiplexer circuit 25.

The normalization coefficient information and the primary additional signal components which are output from the normalization coefficient information increasing/decreasing circuit 22, the secondary additional signal components which are output from the additional signal component normalization coefficient information increasing/decreasing circuit 24, and each code element which is output from the bit reallocating circuit 23 are input to the multiplexer circuit 25, and the multiplexer circuit 25 multiplexes each of the elements and outputs an output code string.

Thus, even when there is no extra bit for adding a new additional signal component to a code string, an additional signal component can be advantageously used by reallocating bits and ensuring a bit amount which allows for adding the additional signal component. Generally, when the fade function in a shape of stairs as descried above is provided, it is perceived as especially remarkable in a case of a signal with a single frequency and a constant amplitude, such as a sine wave, and on the other hand, the advantage of the fade function in the shape of stairs can be hardly perceived in a case of a complicated signal, such as popular music. For a signal as the sine wave described above, there may not be any particular problem since it is likely to be able to save enough extra bits, depending on the bit rate though, where a smooth fade function can still be achieved by adding the additional signal component after executing the process of saving extra bits, as described in the second embodiment.

Figure 9:
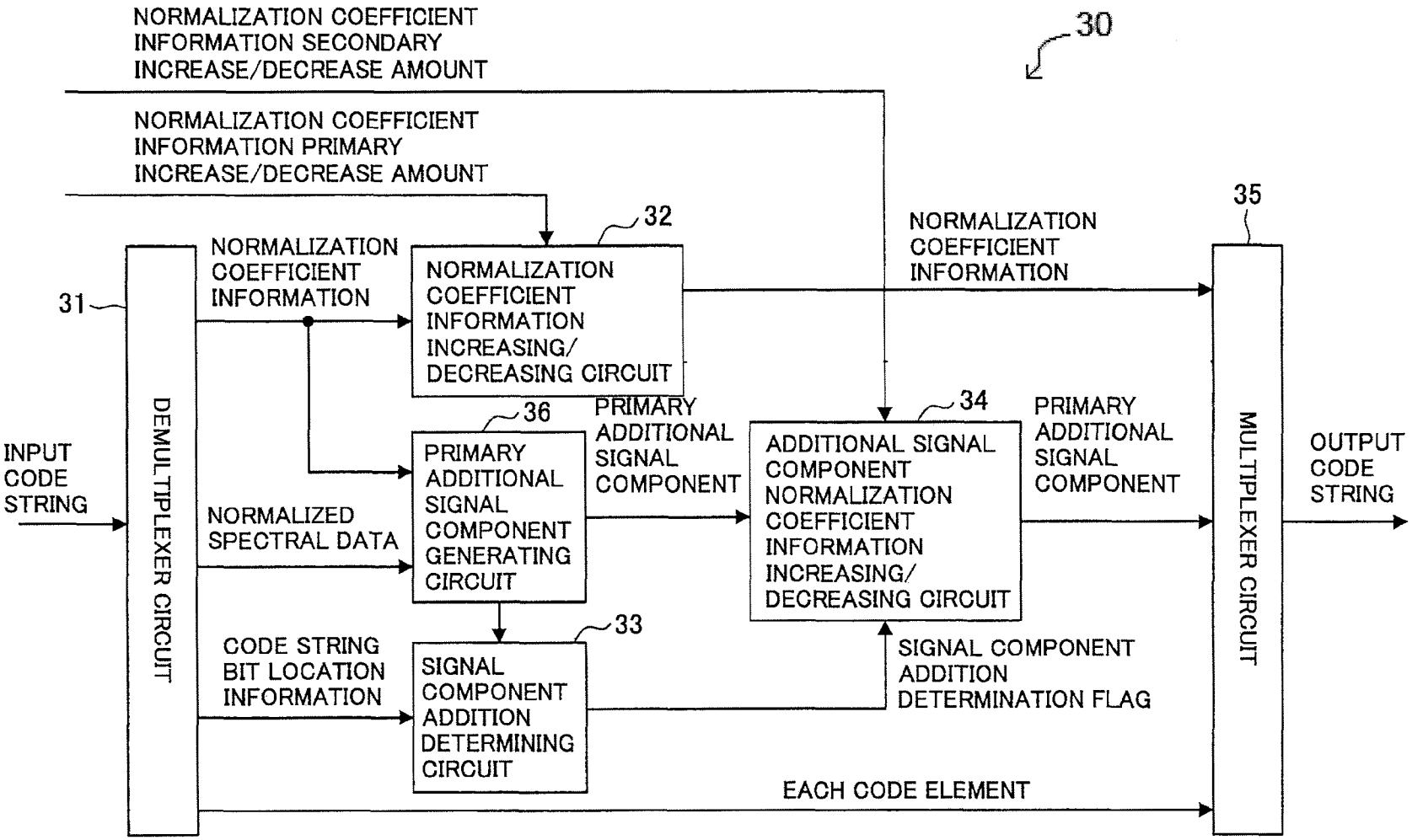
FIG. 9 is a block diagram showing a configuration of a signal processing apparatus of a third embodiment.
Figure 11:
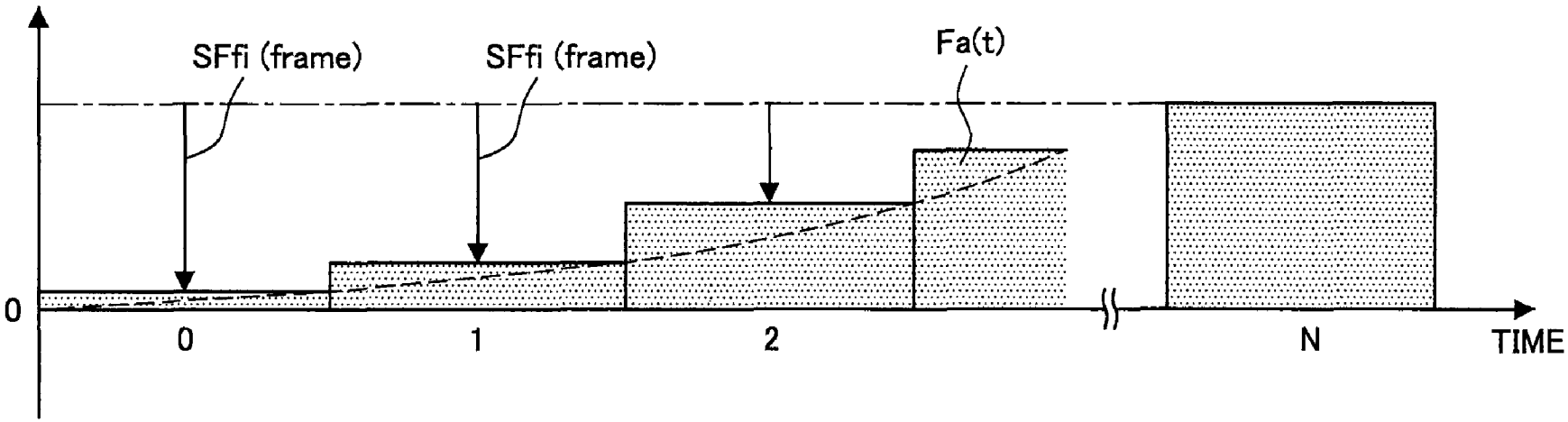

FIG. 9 is a block diagram showing a configuration of a signal processing apparatus of a third embodiment. The signal processing apparatus 30 includes a demultiplexer circuit 31 (demultiplexing means), a normalization coefficient information increasing/decreasing circuit 32 (increasing/decreasing means), a signal component addition determining circuit 33 (determining means), an additional signal component normalization coefficient information increasing/decreasing circuit 34 (additional signal component generating means), a multiplexer circuit 35 (multiplexing means), and a primary additional signal component generating circuit 36 (additional signal component generating means). In addition to the configuration of the signal processing apparatus 10 of the first embodiment, the signal processing apparatus 30 includes the primary additional signal component generating circuit 36. Here, the explanation for the rest of the configuration will be omitted, since it is the same as the configuration of the signal processing apparatus 10 of the first embodiment.

The demultiplexer circuit 31 demultiplexes an input code string, supplies normalization coefficient information to the normalization coefficient information increasing/decreasing circuit 32 and a primary additional signal component generating circuit 36, supplies a normalized spectral data to the primary additional signal component generating circuit 36, supplies code string bit location information to the signal component addition determining circuit 33, and supplies each code element to the multiplexer circuit 35.

The normalization coefficient information increasing/decreasing circuit 32 increases or decreases normalization coefficient information based on a normalization coefficient information primary increase/decrease amount. If the calculation of the normalization coefficient information results in normalization coefficient information above the possible upper limit or below the possible lower limit, it is replaced by the upper or the lower limit, respectively. Normalization coefficient information increased or decreased by the normalization coefficient information increasing/decreasing circuit 32 is supplied to the multiplexer circuit 35.

The signal component addition determining circuit 33 calculates the extra bit amount based on code string bit location information, and compares the extra bit amount and the code amount of the primary additional signal component. If the extra bit amount is over the code amount of the primary additional signal component, it determines that addition of the below-described secondary additional signal component is possible. Otherwise, if the extra bit amount is smaller than the code amount of the primary additional signal component, it determines that addition of the primary additional signal component is impossible. Then, the determination result is output to the additional signal component normalization coefficient information increasing/decreasing circuit 34 as a signal component addition determination flag.

If the signal component addition judgment flag transmitted from the signal component addition determining circuit 33 is TRUE, the additional signal component normalization coefficient information increasing/decreasing circuit 34 increases or decreases normalization coefficient information for the input primary additional signal component, based on the normalization coefficient information secondary increase/decrease amount. At this time, if the normalization coefficient information is above the possible upper limit or below the possible lower limit, it is replaced by the upper or lower limit, respectively. The primary additional signal component generated by the additional signal component normalization coefficient information increasing/decreasing circuit 34 is transmitted to the multiplexer circuit 35.

The normalization coefficient information which is output from the normalization coefficient information increasing/decreasing circuit 32, the primary additional signal component which is output from the additional signal component normalization coefficient information increasing/decreasing circuit 34 and each code element which is output from the demultiplexer circuit 31 are input to the multiplexer circuit 35, and the multiplexer circuit 35 multiplexes each of the elements and outputs an output code string.

The primary additional signal component generating circuit 36 newly extracts a specific spectrum with large amplitude from the normalization coefficient information and the normalized spectral data in the code string to make it a new primary additional signal component.

With no need to change the original spectral data, the signal processing apparatus 30 may modify the normalization coefficient information by the above-described method, using the normalization coefficient information primary increasing/decreasing amount, and for the newly generated primary additional signal component, modify the normalization coefficient information of the primary additional signal component by using the normalization coefficient information secondary increase/decrease amount.

Thus, even when there is no primary additional signal component in the code string, a smooth fade function can be achieved, by generating a primary additional signal component and applying a normalization coefficient information secondary increase/decrease amount.

What is claimed is:

1. A signal processing apparatus operable to adjust a level of an audio signal in a code string obtained by converting a time signal to a frequency component, demultiplexing the frequency component into a plurality of demultiplexed signal components, normalizing independently each of the plurality of demultiplexed signal components, and quantizing, coding and multiplexing the normalized demultiplexed signal components, the signal processing apparatus comprising:

demultiplexing means for demultiplexing the code string;

increasing/decreasing means for adding or subtracting a first integer value to/from a normalization coefficient of each of the plurality of the demultiplexed signal components;

additional signal component generating means for copying the demultiplexed signal component of a subset of the plurality of the demultiplexed signal components, adding or subtracting a second integer value to/from the normalization coefficient of each of the demultiplexed signal component of the subset, and generating an additional signal component; and multiplexing means for multiplexing the plurality of demultiplexed signal components and the additional signal component.

2. The signal processing apparatus according to claim 1, comprising determining means for determining whether an extra bit which allows for adding the additional signal component exists in the code string, wherein the additional signal component generating means generates the additional signal component when the extra bit which allows for adding the additional signal component exists in the code string.

3. The signal processing apparatus according to claim 1, comprising bit reallocating means for reducing bits in the code string and producing the extra bit which allows for adding the additional signal component.

4. The signal processing apparatus according to claim 1, comprising:

level controlling means for calculating the first and second integer values based on a control function for adjusting the level of the signal, wherein the level controlling means calculates the second integer so as to compensate a difference between a value of the control function and the level of the signal adjusted by the first integer value.

5. A signal processing method of adjusting a level of an audio signal in a code string obtained by converting a time signal to a frequency component, demultiplexing the frequency component into a plurality of demultiplexed signal components, normalizing independently each of the plurality of demultiplexed signal components, and quantizing, coding and multiplexing the normalized demultiplexed signal components, the signal processing method comprising:

a demultiplexing step of demultiplexing the code string;

an increasing/decreasing step, by using a signal processing apparatus, of adding or subtracting a first integer value to/from a normalization coefficient of each of the plurality of the demultiplexed signal components; and an additional signal component generating step, by using the signal processing apparatus, of copying the demultiplexed signal component of a subset of the plurality of the demultiplexed signal components, adding or subtracting a second integer value to/from the normalization coefficient of each of the signal component of the subset, and generating an additional signal component; and a multiplexing step of multiplexing the plurality of demultiplexed signal components and the additional signal component.

6. A non-transitory computer-readable medium containing a program for causing a computer to execute signal processing method of adjusting a level of an audio signal in a code string obtained by converting a time signal to a frequency component, demultiplexing the frequency component into a plurality of demultiplexed signal components, normalizing independently each of the plurality of demultiplexed signal components, and quantizing, coding and multiplexing the normalized demultiplexed signal components, the program comprising:

a demultiplexing step of demultiplexing the code string;

an increasing/decreasing step of adding or subtracting a first integer value to/from a normalization coefficient of each of the plurality of the demultiplexed signal components;

an additional signal component generating step of copying the demultiplexed signal component of a subset of the plurality of the demultiplexed signal components, adding or subtracting a second integer value to/from the normalization coefficient of each of the signal component of the subset, and generating an additional signal component; and a multiplexing step of multiplexing the plurality of signal components and the additional signal component.

* * * * *